US005370470A

United States Patent [19]

Kim

[11] Patent Number: 5,370,470

[45] Date of Patent: Dec. 6, 1994

[54] INK FILM TENSION DEVICE FOR COLOR VIDEO PRINTER

[75] Inventor: Jae S. Kim, Suwon, Rep. of Korea

[73] Assignee: Goldstar Co., Ltd., Seoul, Rep. of Korea

[21] Appl. No.: 989,717

[22] Filed: Dec. 14, 1992

[30] Foreign Application Priority Data

Dec. 14, 1991 [KR] Rep. of Korea ..... 23026/1991

[51] Int. Cl.[5] ..... B41J 33/52

[52] U.S. Cl. ..... 400/234; 400/218; 242/147 R; 226/195

[58] Field of Search ..... 400/120, 208, 218, 222, 400/230, 234, 621; 242/147 R, 156; 226/195

[56] References Cited

U.S. PATENT DOCUMENTS

| | | | |
|---|---|---|---|
| 4,273,454 | 6/1981 | Anagnostopoulos | 400/234 |
| 4,650,351 | 3/1987 | Engle et al. | 400/234 X |
| 5,143,461 | 9/1992 | Inoue et al. | 400/234 X |

FOREIGN PATENT DOCUMENTS

| | | | |
|---|---|---|---|
| 2542259 | 12/1976 | Germany | 400/234 |
| 2925618 | 1/1981 | Germany | 400/234 |
| 0156786 | 9/1984 | Japan | 400/234 |
| 0185687 | 10/1984 | Japan | 400/234 |
| 0197267 | 9/1986 | Japan | 400/234 |
| 0164575 | 7/1987 | Japan | 400/234 |
| 0297085 | 12/1988 | Japan | 400/234 |

*Primary Examiner*—Edgar S. Burr
*Assistant Examiner*—Christopher A. Bennett
*Attorney, Agent, or Firm*—Fliesler, Dubb, Meyer & Lovejoy

[57] ABSTRACT

An ink film tension device for applying a tension to an ink film used in a color video printer comprising a fixed shaft fixedly mounted to a reel bracket, a resilience member rotatably mounted to the fixed shaft, a reel body rotatably mounted to the fixed shaft and operatively connected to the ink film, and a felt interposed between the reel hub and the reel body and adapted to operatively connect the reel body to the reel hub. The resilience member has one end fixedly mounted to the reel bracket and the other end having a protruded bent portion. The reel hub has a support hole for receiving the other end of the resilience member. To the reel bracket is mounted a stopper which is adapted to selectively engage with the protruded bent portion of the other end of the resilience member, for limiting the torsion of the resilience member and thus maintaining a tension of a predetermined level at the resilience member.

2 Claims, 5 Drawing Sheets

INK FILM TENSION DEVICE FOR COLOR VIDEO PRINTER

BACKGROUND OF THE INVENTION

1. Field of the Invention

The present invention relates to an ink film tension device for applying a tension to an ink film in a cartridge used in a color video printer, and more particularly to an ink film tension device for applying a reverse rotation force to a supply reel of the cartridge, so as to apply a tension to the ink film.

2. Description of the Prior Art

Referring to FIG. 1, there is illustrated a general color video printer. As shown in FIG. 1, the color video printer comprises a printer body 1 and a cartridge receiving guide 2 disposed in the interior of printer body 1. A holder 5 is pivotally mounted to the printer body 1 to pivot about a pivot pin 6 and disposed above the cartridge receiving guide 2. The holder 5 carries a thermal print head 3 and a thermal print head sensor 4. Beneath the cartridge receiving guide 2, a pinch roller 7 and a grip roller 8 are disposed which are in press contact with each other at a certain pressure. Near the rollers 7 and 7 is disposed a platen roller 9.

In the cartridge receiving guide 2, a cartridge 10 is received which includes a rotatable supply reel 11 and a rotatable take-up reel 12 spaced from the supply reel 11, as shown in FIGS. 2A and 2B. An ink film 13 is wound around the supply reel 11 and the take-up reel 12. The cartridge 10 also has a rectangular opening at its bottom portion.

The ink film 13 has three color portions, that is, a yellow portion 15, a cyan portion 16 and a magenta portion (not shown). As shown in FIG. 2A, a transparent portion 17 is provided between the yellow portion 15 and the cyan portion 16, at the initial operation portion of the ink film 13.

The color video printer with the above-mentioned construction operates under the condition that the cartridge 10 is loaded in the cartridge receiving guide 2. As the holder 5 pivots in a counter-clockwise direction about the pivot pin 6 under the condition that a copy sheet 18 has been fed between the pinch roller 7 and the grip roller 8, the thermal print head sensor 4 senses the transparent portion 17 formed between the yellow portion 15 and the cyan portion 16 of the ink film 13 and sets the standby position of the ink film for initiating a printing from the yellow portion 15.

At this time, the ink film 13 which has been at a position A in FIG. 1 is lowered to be at a position A' in FIG. 1 so that it comes into contact with the copy sheet 18 being fed according to the rotation of pinch roller 7, so as to achieve a printing.

After the printing; the holder 5 pivots in a clockwise direction about the pivot pin 6 and returns to its original position. Simultaneously, the ink film 13 returns from the position A' to the position A. However, the returning operation of ink film 13 may not be assuredly carried out. In this case, the ink film 13 may be released, thereby causing it to get caught in the cartridge receiving guide 2 and thereby tear and damage. As a result, it is difficult to obtain a good quality of pictures.

An ink film tension device for avoiding such a phenomenon has been known which applies a tension to the ink film by rotating reversely the supply reel of cartridge through a certain angle after the holder returns. A typical example of such an ink film tension device is illustrated in FIGS. 3 and 4.

As shown in FIGS. 3 and 4, the ink film tension device comprises a fixed shaft 22 fixedly mounted to a reel bracket 21, a resilience member 23 disposed around the fixed shaft 22, and a reel hub 25 rotatably mounted to the fixed shaft 22 and surrounding the resilience member 23. The reel hub 25 has a gear portion 24 at its peripheral surface. A reel body 27 is also rotatably mounted to the fixed shaft 22 to rotate integrally with the reel hub 25 by means of a felt member 26 interposed between the reel hub 25 and the reel body 27. With the gear portion 24 of the reel hub 25 is engaged a worm gear 28 which is also engaged with a worm 30 of a motor 29.

In the ink film tension device with the above-mentioned construction, the motor 29 is actuated, just after the holder 5 returns to its original position. As the motor 29 drives, its drive force is transmitted through the worm 30, the worm gear 28, the gear portion 24 of reel hub 25, the felt 26, to the reel body 27 so that a hub 31 of the cartridge 10 engaged with the reel body 27 rotates through a certain angle, thereby causing the ink film 13 to be reversely fed. Accordingly, the ink film 13 is maintained at a tensed state.

However, this conventional ink film tension device requires the use of an additional motor such as the motor 29 and has a complicated construction, resulting in an increase in manufacture cost and a decrease in productivity.

SUMMARY OF THE INVENTION

Therefore, an object of the invention is to eliminate the above-mentioned disadvantages encountered in the prior art and to provide an ink film tension device for a color video printer, capable of maintaining a tension of an ink film with a simple construction and without a separate motor.

In accordance with one aspect, the present invention provides an ink film tension device for applying a tension to an ink film used in a color video printer comprising: means for generating a tension to be applied to the ink film; means for maintaining the generated tension at a predetermined level: and means for transmitting the tension to the ink film.

In accordance with another aspect, the present invention provides an ink film tension device for applying a tension to an ink film used in a color video printer comprising a fixed shaft fixedly mounted to a reel bracket, a resilience member rotatably mounted to the fixed shaft, a reel body rotatably mounted to the fixed shaft and operatively connected to the ink film, and a felt interposed between the reel hub and the reel body and adapted to operatively connect the reel body to the reel hub, the device being characterized in that the resilience member has one end fixedly mounted to the reel bracket and the other end having a protruded bent portion, that the reel hub has a support hole for receiving the other end of the resilience member, and that a stopper is fixed to the reel bracket and adapted to selectively engage with the protruded bent portion of the other end of the resilience member, for maintaining a tension of a predetermined level at the resilience member.

BRIEF DESCRIPTION OF THE DRAWINGS

Other objects and aspects of the invention will become apparent from the following;description of embodiments with reference to the accompanying drawings in which.

DESCRIPTION OF THE PREFERRED EMBODIMENTS

Figure 1:
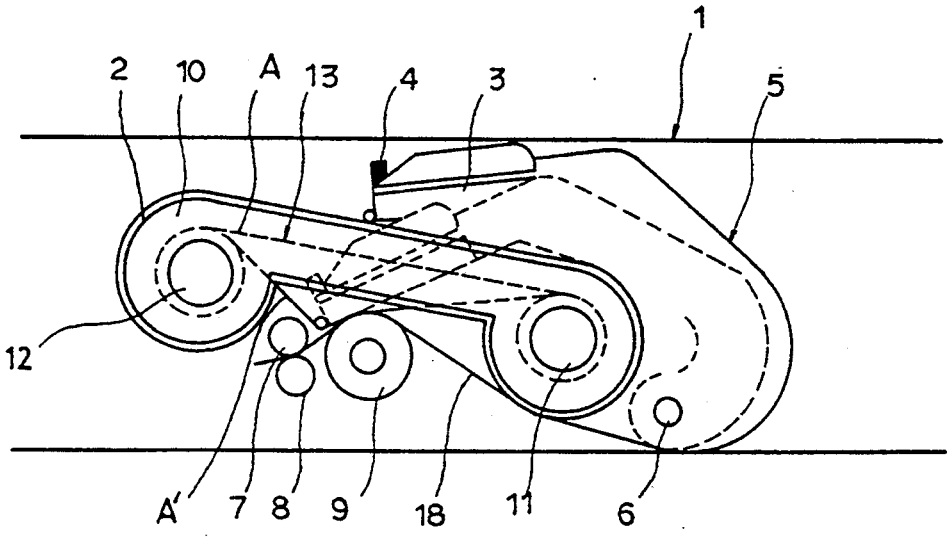
FIG. 1 PRIOR ART
FIG. 1 is a schematic sectional view of a general color video printer, showing an ink film cartridge loaded in the printer.
Figure 2A:
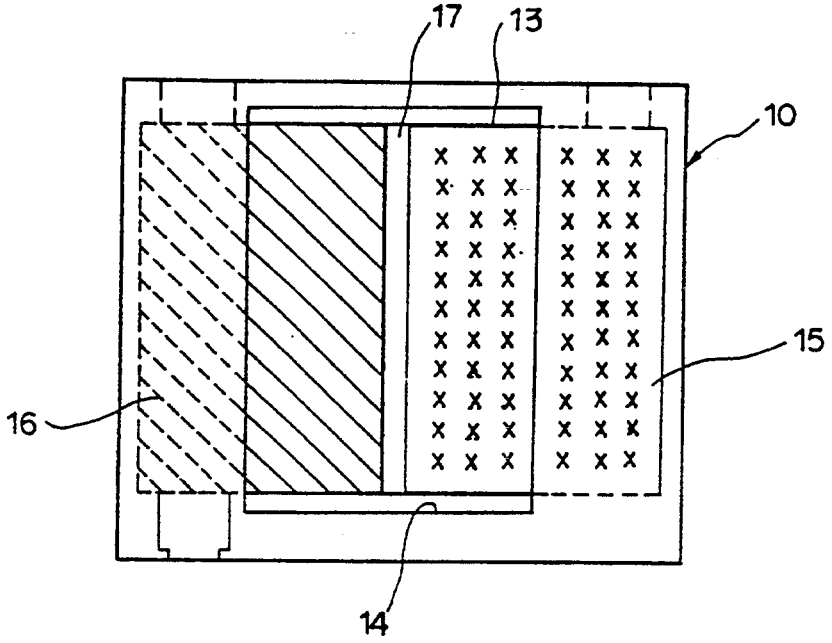
FIG. 2A PRIOR ART
FIGS. 2A and 2B are schematic bottom view and front view of a general ink film cartridge for a color video printer, respectively.
Figure 2B:
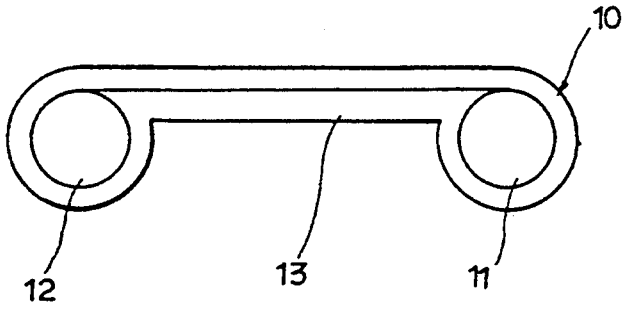
FIG. 2B PRIOR ART
Figure 3:
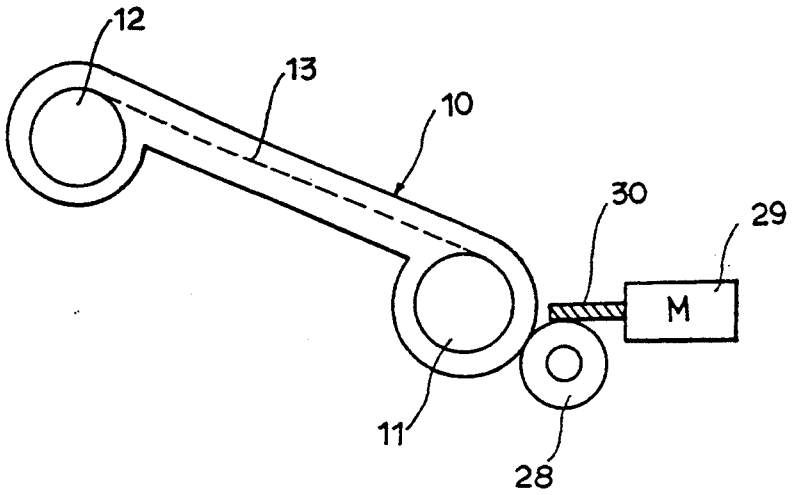
FIG. 3 PRIOR ART
FIG. 3 is a schematic front view of a conventional ink film tension device for a color video printer.
Figure 4:
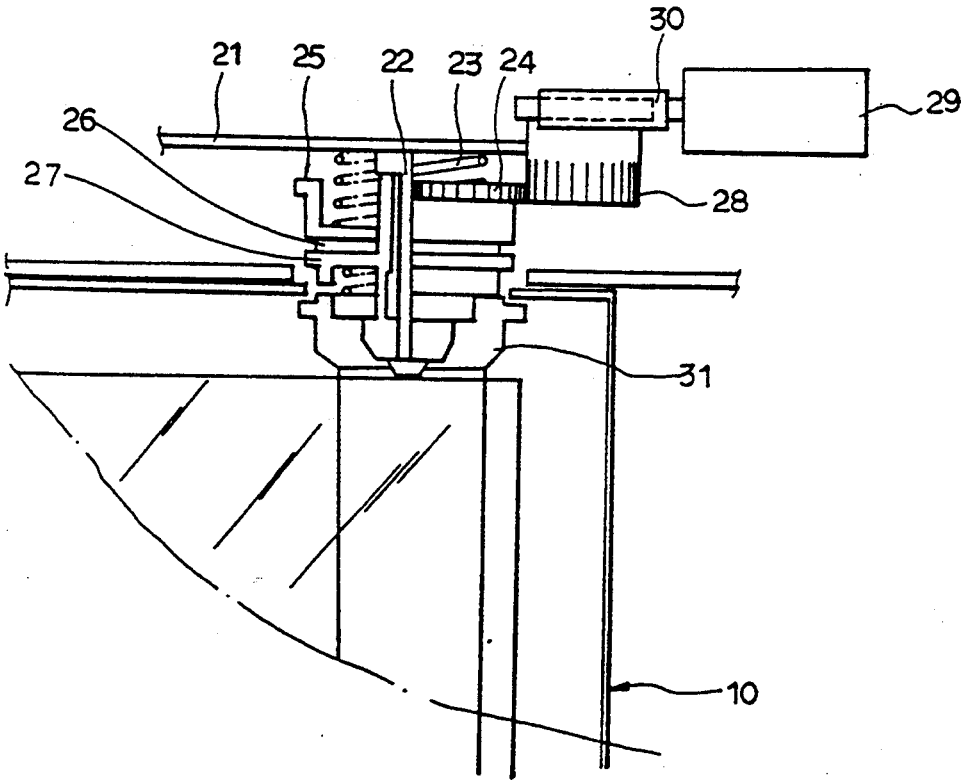
FIG. 4 PRIOR ART
FIG. 4 is a partial sectional view of the conventional ink film tension device shown in FIG. 3.
Figure 5:
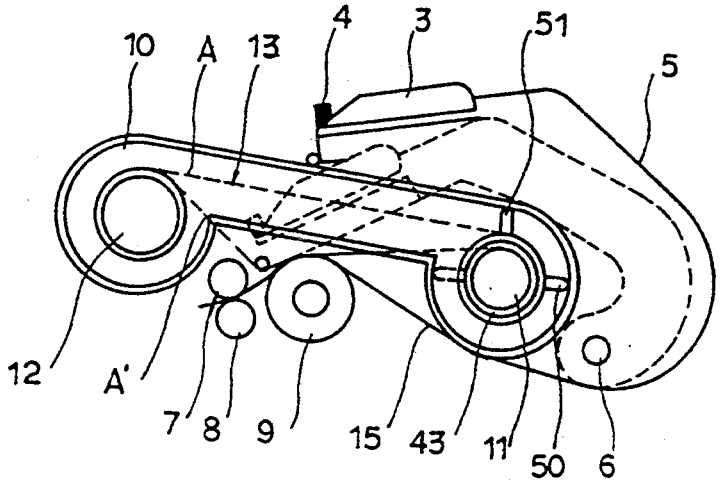
FIG. 5 is a schematic front view of an ink film tension device for a color video printer in accordance with the present invention.
Figure 6:
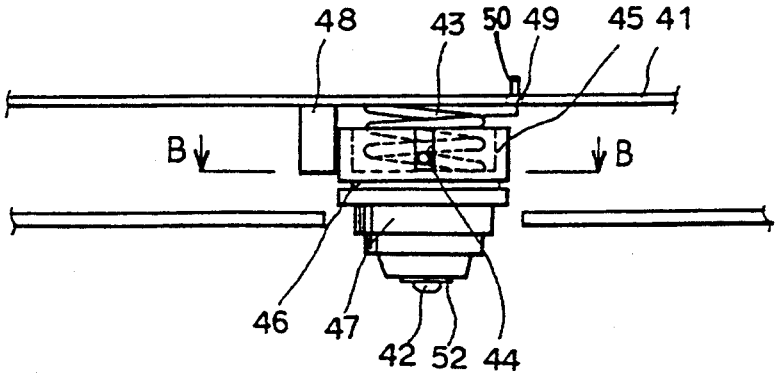
FIG. 6 is a schematic plan view of the ink film tension device shown in FIG. 5.

FIGS. 5 and 6 are a front view and a plan view illustrating an ink film tension device for a color video printer according to the present invention, respectively, In the drawings, the same reference numerals as those in FIGS. 1 and 2 denote the identical elements.

As shown in FIGS. 5 and 6, the device comprises a fixed shaft 42 fixedly mounted to a proper portion of a reel bracket 41, a resilience member 43 disposed around the fixed shaft 42 and fixedly mounted at its first end to the reel bracket 41, and a reel hub 45 rotatably mounted to the fixed shaft 42 and surrounding the resilience member 43. The reel hub 55 has a support hole 44 for supporting a second end of the resilience member 43. A reel body 47 is also rotatably mounted to the fixed shaft 42 to rotate integrally with the reel hub 45 by means of a felt member 46 interposed between the reel hub 45 and the reel body 47. A stopper 48 is also mounted to the reel bracket 41 near the fixed shaft 42, but outwardly of the reel hub 45. The stopper 48 is brought into contact with the second end of the resilience member 43 upon the rotation, namely, the torsion of the resilience member 43, to limit the torsion of the resilience member 43 to a predetermined level.

Figure 7:
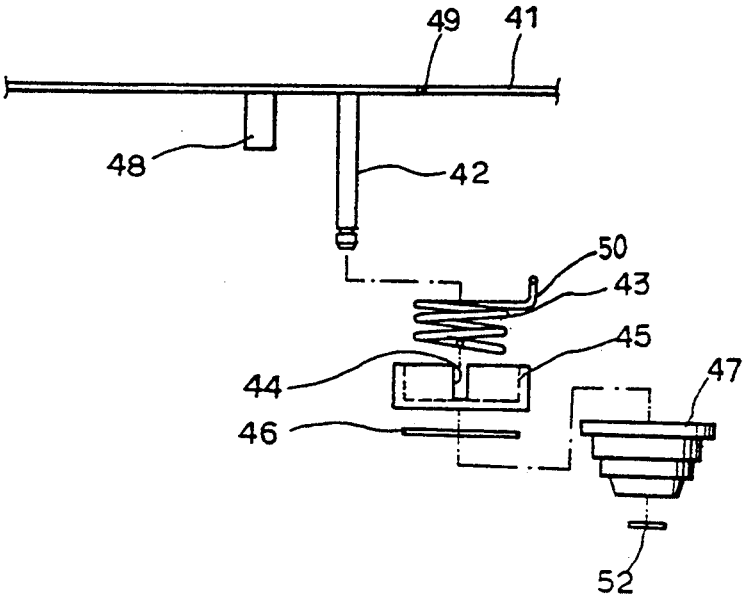
FIG. 7 is an exploded view of the ink film tension device shown in FIG. 6.
Figure 8:
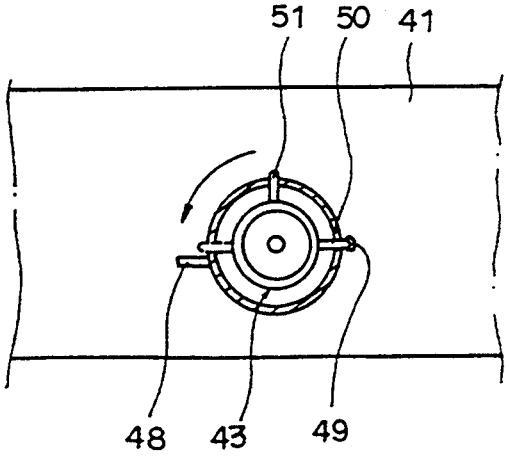
FIG. 8 is a cross-sectional view taken along the line B—B of FIG. 6, showing the operation of a resilience member of the ink film tension device shown in FIG. 5.

As shown in FIGS. 7 and 8, the resilience member 43 is of a torsion coil spring shape and preferably has a first bent portion 50 formed at first end thereof and supported by a support hole 49 formed at the reel bracket 41 and a second bent portion 51 formed at the second end thereof and supported by the support hole 44 of the reel hub 45.

However, the resilience member 43 is not limited to the illustrated torsion coil spring and other types of resilience members may be also used, so long as they have a resilience for providing the same effect as the resilience member 43.

In FIGS. 6 and 7, the reference numeral 52 denotes a washer.

Now, the operation of the ink film tension device with the above-mentioned construction according to the present invention will be described.

As the holder 5 pivots in a counter-clockwise direction about the pivot pin 6 for detecting the position of ink film 13 of the cartridge 10, as shown in FIG. 5, the ink film 13 is lowered from the position A to the position A', in a conventional manner. Accordingly, the supply reel 11 rotates through an angle corresponding to the take-out amount of the ink film 13 upon lowering.

Under this condition, as the ink film 13 comes into contact with a copy sheet 18 travelling by the rotation of pinch roller 7, a printing operation is carried out in a conventional manner.

During such a printing operation, the supply reel 11 rotates continuously, so as to take out the ink film from the supply reel 11 continuously. During the rotation, the supply reel 11 is continuously subjected to a torque of a predetermined level by the resilience member 43 and the felt member 46.

That is, during the printing operation, the resilience member 43 is maintained at a state that it has twisted through a predetermined angle such that its second bent portion 51 is brought into contact with the stopper 48.

Accordingly, a resilience, namely, a torque is stored in the resilience member 43. When the ink film 13 is taken out of the supply reel 11, the resilience functions as a force always exerting in a direction reverse to the take-out direction of the ink film. As a result, a proper amount of tension is always maintained at the ink film 13.

When the holder 5 returns to its original position after the printing operation is completed or after the thermal print head sensor 4 senses the position of ink film 13, the resilience member 43 also returns to its original position, by virtue of its resilience. As a result, the second bent portion 51 of the resilience member 43 which has been maintained at a position indicated by a phantom line in FIG. 8 is moved to a position indicated by a solid line in FIG. 8, so that the torque of the resilience member 43 is reversely transmitted through the reel hub 45, the felt member 46 and the reel body 47, to the hub 31 of cartridge 10. As a result, the supply reel 11 rotates reversely through a predetermined angle, thereby causing the ink film 13 to be subjected to a tension.

As apparent from the above description, the present invention provides an ink film tension device for a color video printer comprising a resilience member with a construction capable of storing a torque, namely, a reverse rotation force corresponding to the lowered movement of the ink film. With this construction, when the holder returns to its original position after the printing operation is completed or after the thermal print head sensor senses the position of ink film, the resilience member also returns to its original position, by virtue of its resilience. Accordingly, a proper tension is maintained at the ink film.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An ink film tension device for applying a tension to an ink film used in a color video printer comprising:

a reel bracket and a stopper fixed to the reel bracket, a fixed shaft fixedly mounted to the reel bracket, a resilience member, rotatably mounted around the fixed shaft, having a first end fixedly mounted to the reel bracket and a second end having a protruded bent portion which rotatably contacts the stopper, and providing a reverse rotational force on an ink film to maintain the ink film in a tension and prevent the ink film from sagging, a reel hub rotatably mounted to the fixed shaft having a support hole for receiving the second end of the resilience member and adapted to selectively engage with the protruded bent portion of the second end of the resilience member for maintaining the tension of the resilience member at a predetermined level, a reel body rotatably mounted to the fixed shaft and operatively connected to the ink film wherein the reel body rotates in unison with the reel hub and only rotates independently of the reel hub in a direction of the ink film advancement while the second end other resilience member is in contact with the stopper, a felt member interposed between the reel hub and the reel body and adapted to operatively connect the reel body to the reel hub wherein a frictional force exists between the felt member and the reel hub such that the frictional force is sufficient to prevent rotational slippage between the reel hub, the felt member, and the reel body when the ink film is not continuously advancing and the reverse rotational force does not exceed the frictional force.

2. An ink film tension device for applying a tension to an ink film used in a color video printer where the printer has a printing head for engaging the ink film comprising:

a reel bracket and a stopper fixed to the reel bracket, a fixed shaft fixedly mounted to the reel bracket, a resilience member, rotatably mounted around the fixed shaft, having a first end fixedly mounted to the reel bracket and a second end having a protruded portion which rotates to contact the stopper when the ink film is drawn forward and the printing head engages the ink film, and providing a reverse rotational force on an ink film to maintain tension on the ink film and prevent the ink film from sagging, a reel hub rotatably mounted to the fixed shaft and having a support hole for receiving the second end of the resilience member and adapted to engage with the protruded portion for maintaining the tension at a predetermined level when the ink film is drawn in the forward direction and the printing head engages the ink film, a felt member, a reel body rotatably mounted to the fixed shaft and operatively connected to the reel hub by said felt member interposed between the reel hub and the reel body wherein the reel body rotates together with the reel hub when the ink film advances in the forward direction and the printing head engages the ink film until the protruded portion is in contact with the stopper; wherein the reel body rotates independently of the reel hub when the ink film advances in the forward direction, the printing head engages the ink film and the protruded portion is in contact with the stopper; and wherein the reel body rotates together with the reel hub to retract the ink film in the rearward direction when the printing head disengages the ink film whereby sagging of the ink film is prevented.

* * * * *